United States Patent [19]

Matsuda et al.

[11] 4,040,193

[45] Aug. 9, 1977

[54] DISPLAY DEVICE

[75] Inventors: Isamu Matsuda, Yao; Taizo Ono, Neyagawa, both of Japan

[73] Assignee: Matsushita Electric Industrial Co., Ltd., Kadoma, Japan

[21] Appl. No.: 694,488

[22] Filed: June 9, 1976

[30] Foreign Application Priority Data

| | | |
|---|---|---|
| June 10, 1975 | Japan | 50-78777[U] |
| June 10, 1975 | Japan | 50-78778[U] |
| July 11, 1975 | Japan | 50-97100[U] |
| Sept. 23, 1975 | Japan | 50-130345[U] |

[51] Int. Cl.[2] ..... G09F 7/00

[52] U.S. Cl. ..... 40/28 C; 40/106.45

[58] Field of Search ..... 40/28 C, 133 R, 130 J, 40/130 C, 52, 106.45

[56] References Cited

U.S. PATENT DOCUMENTS

| | | | |
|---|---|---|---|
| 2,096,360 | 10/1937 | Heller | 40/28 C |
| 3,096,594 | 7/1963 | Skrobrich | 40/28 C |
| 3,199,098 | 8/1965 | Schwartz | 40/28 C |
| 3,975,728 | 8/1976 | Winrow | 40/28 C |

*Primary Examiner*—Russell R. Kinsey
*Assistant Examiner*—Wenceslao J. Contreras
*Attorney, Agent, or Firm*—Wenderoth, Lind & Ponack

[57] ABSTRACT

A display element is rotatably mounted and has a surface portion which includes a nontransparent area and a transparent area, and these two areas are different colors than each other. Such element is mounted behind a front panel having an opening facing the element. By controlling the rotational position of the display element, one of above described areas is selectively displayed. The transparent area can be positioned partly inside and partly outside the front panel, and light from a light source provided inside the front panel can be scattered through the display element.

5 Claims, 26 Drawing Figures

DISPLAY DEVICE

BACKGROUND OF THE INVENTION

1. Field of the Invention

This invention relates to a display device having a display element capable of assuming visually different states, and a plurality of which can be arranged to display a letter, a numeral etc., by selectively positioning each of the display elements in one of above-mentioned different states selectively, and more particularly pertains to such a device in which the display element has visually-different surface portions and is rotated to display one of such portions.

2. Description of the Prior Art

Hitherto known display devices for displaying a numeral, a letter, etc., for a large digital clock, score indications at gymnasia, road information indications, etc., are known.

One example of such a prior art device is as shown in FIGS. 1 and 2. In this figure, numeral 1 represents an axis and a display element 2 in the form of a spherical body is rotatably supported on the axis 1 in the plane of a panel 8. The surface of the display element 2 has a black colored portion 3 and a yellow colored (containing a luminous paint) portion 4, each portion extending over about 180° of the circumferential surface of the body 2. A permanent magnet 5 is provided within the display element 2. Adjacent to the display element 2 is an electromagnet 6 with one end of its core 7 facing the permanent magnet 5. By selectively polarizing the electromagnet 6, the desired surface i.e. either the black colored portion 3 or the yellow colored portion 4 can be displayed by creating a repelling or attracting force between the electromagnet 6 and the permanent magnet 5. By arranging a plurality of such units in a matrix, as shown in FIG. 2, and displaying the yellow colored portion 3 of suitable units a desired numeral or letter can be displayed. In the daytime, contrast of the display with the panel is obtained by reflection of sunlight, but at night the display elements 2 are irradiated with ultraviolet rays from a black light, so that luminous paint coated on the yellow colored portion 4 emits luminescence to give contrast to the display.

The display by such luminescence, however, lacks clearness. In practice sufficient doses of black light are not delivered from the black light to the display elements when the arrangement is located far from the black light, resulting in extremely poor brightness. Therefore brightness is not uniform over the whole area of the arrangement so that visibility is not good.

Furthermore the luminous paint deteriorates with the passage of time, decreasing brightness. Especially in use outdoors the deterioration is so severe that the service life of the display element 2 is short.

Further because the luminous paints are available only in a small number of color types, the display color is limited.

Another example of a prior art display device is one in which a plurality of electric bulbs or fluorescent lamps are arranged in a matrix or in a figure "⊟", and the display of a numeral or a letter is made by turning on the electric bulbs or the fluorescent lamps at specified positions.

Such a display device, however, has drawbacks as follows:

1. It is hard to be seen when exposed to direct sunlight.

2. Since the electric bulbs or the fluorescent lamps need to be always energized when the indication is continuously made, the amount of power consumed is large.

3. Since many bulbs or fluorescent lamps are used, maintenance of the device including their replacement because of breakage is costly.

SUMMARY OF THE INVENTION

The first object of this invention is to provide a display device which can display a numeral, a letter, etc. clearly both in the daytime and at night.

The second object of this invention is to provide a display device in which the composition of the device for night displaying is improved so that maintenance because of deterioration or breakage is easy.

These objects are achieved by this invention, wherein a display element is made partly transparent in such manner that the transparent portion can be positioned partially inside and partially outside the panel of the device at the same time and light can be irradiated on the display element from inside of the device, so that when the transparent portion is displayed the light from inside will be scattered through the display element.

BRIEF DESCRIPTION OF THE DRAWINGS

Other objects and advantageous features of this invention will be apparent from the following explanation taken in connection with some embodiments thereof shown in the accompanying drawings, in which.

DETAILED DESCRIPTION OF THE PREFERRED EMBODIMENTS

Figure 1:
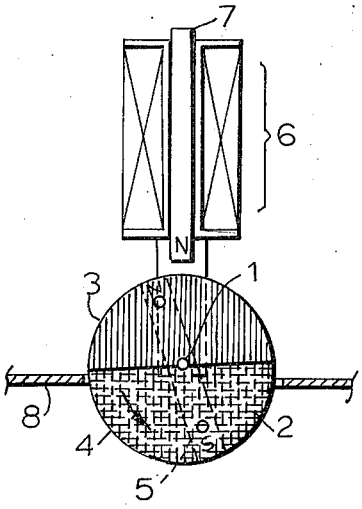
(PRIOR ART) FIG.1
FIG. 1 is a sectional view, on an enlarged scale, of one element of a conventional display device.
Figure 2:
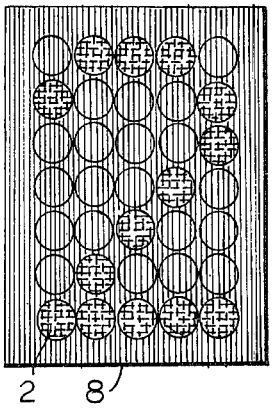
FIG. 2 is a plan view of a conventional display device using the elements of FIG. 1.
Figure 3:
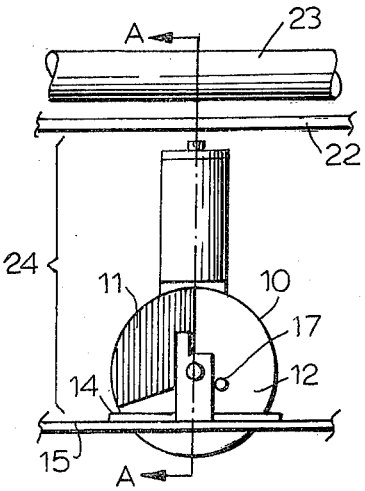
FIG. 3 is an elevational view of one embodiment of a display device according to this invention.
Figure 4:
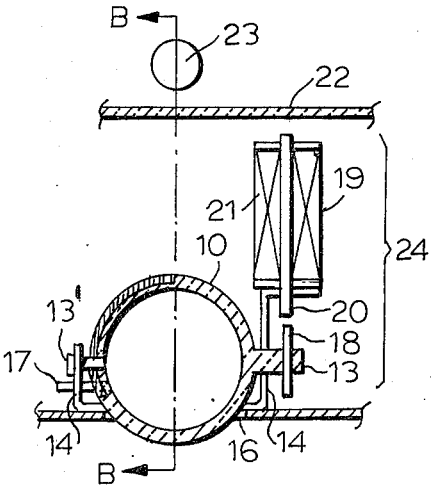
FIG. 4 is a sectional view taken on line A—A of FIG. 3.

Referring to FIGS. 3 -6 which show the first embodiment of this invention, a hollow ball shape display element 10 has spherical lune 11 of the outer circumferential surface thereof contained in an angle of about 120° nontransparent (e.g., coated black), and the remaining part 12 transparent (e.g., made of highly transparent, yellow acrylic resin). An axle 13 integral with the display element 10 on one side thereof is rotatably supported by one upstanding portion of supporting plate 14 and a supporting pin 13 is securely mounted on the other side of the display element and is rotatably mounted in the other upstanding portion of plate 14 for supporting the display element 10. A panel 15 coated black, the same color as the nontransparent part 11 of the display element 10, has a hole 16 therein through which a portion of display element 18 projects and in which the display element 10 is rotatable. The supporting plate 14 is securely mounted on the panel 15, and has a hole aligned with the hole 16 in the panel 15. A stop pin 17 is securely mounted on the display element 10, which limits the rotation of the display element 10 by abutting the supporting plate 14. A permanent magnet 18 is securely mounted on the axle 13 and an electromagnet 19 is mounted on an extension on the supporting plate 14, which electromagnet is composed of an iron core 20 facing the end of the permanent magnet 18 with a gap therebetween and a coil 21. A light diffusing plate 22 is provided for the purpose of uniformly diffusing on the display element 10 the light radiated from a light source 23 such as a fluorescent lamp. Plate 22 may be formed of a milky white acrylic resin, for example.

Figure 5:
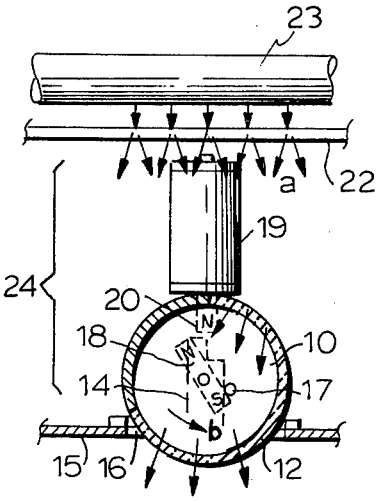
FIGS. 5 and 6 are sectional views taken on line B—B of FIG. 4 for explaining the operation of the display device of FIG. 3.

The operation of the embodiment constructed as described above is as follows: FIG. 5 shows the condition of this device in which a display is formed with the yellow transparent part 12. During the daytime, the display element 10 forms the display by the reflection from the transparent part 12, which is clearly visible even when exposed to the sun's rays. At night, the light source 23 is turned on. Then, the light produced from the light source 23 is uniformly diffused through the light diffusing plate 22, and passes through the plate 22 as indicated by the arrow a, reaching the display element 10. Since the right half of the display element 10 is composed of the yellow transparent part 12, the light passes through the right half of the display element 10, and is scattered throughout the display element 10 while being transmitted therethrough. It, then, comes out through the yellow transparent part 12 projecting through the panel 15. Thus, the display element 10 produces a very clear display, giving a shining appearance like an electric bulb. Although the left half of the display element 10 is composed of the black nontransparent part 11, the light is scattered throughout the display element 10 with the right half being of the transparent material, not allowing the left half with the black nontransparent part 11 to cast a shadow. Accordingly, the yellow transparent part 12 which is visible through the hole 16 of the panel 15 shows no irregularity in the emitted light, giving a uniformly shining overall appearance to the display element 10. Furthermore, if the light source 23 or the light diffusing plate 22 is colored differently from the transparent part 12 of the display element 10, e.g., red, then the display may be made yellow in the daytime, while a mixed color of yellow and red, i.e., orange, may be produced at night. If a sodium lamp is used for the light source 23, high visibility is obtained even in the rain or mist.

Figure 6:
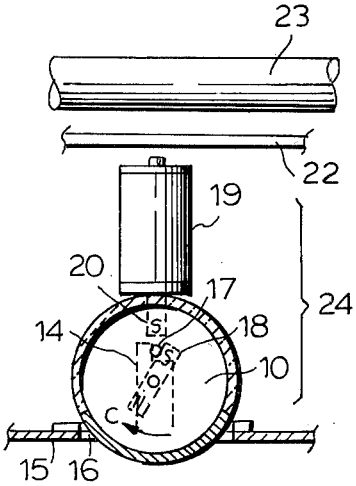

Then, when the coil 21 is energized so as to produce a N pole at the tip of the iron core 20, as shown in FIG. 5, it repels the N pole of the permanent magnet 18, while attracting the S pole, causing the display element 10 to turn in the direction shown by the arrow *b*. When the display element 10 has made a 120° turn, the stop pin 17 abuts the supporting plate 14, as shown in FIG. 6, bringing its rotation to a stop. In this condition, the black nontransparent part 11 faces the hole 16, as shown in FIG. 6, and even if the light source 23 is turned on at night, the light will not leak out through the panel 15, being shielded by the black nontransparent part 11.

If the condition of FIG. 5 is needed again, the coil 21 is so energized as to produce the S pole at the tip of the iron core 20, as shown in FIG. 6. It repels the S pole of the permanent magnet 18, while attracting the N pole, causing the display element 10 to turn in the direction shown by the arrow *c*. When the display element 10 has made a 120° turn, the stop pin 17 abuts the supporting plate 14, as shown in FIG. 5, bringing its rotation to a stop. Thus, the display is made by means of the yellow transparent part 12.

In such device, the coil 21 need be energized only for the short period of time necessary to alter the substance of the display (the time taken for the display element 10 to turn to expose the different part through the hole 16); thereafter a self-maintaining magnetic force is produced through the attraction between the permanent magnet 20 and the electromagnet 19, thereby making it possible to hold the condition of the display unaltered. There is, for this reason, no need for energizing the coil 21 unless the display is to be altered, resulting in very small consumption of power and economy of operation.

Figure 7:
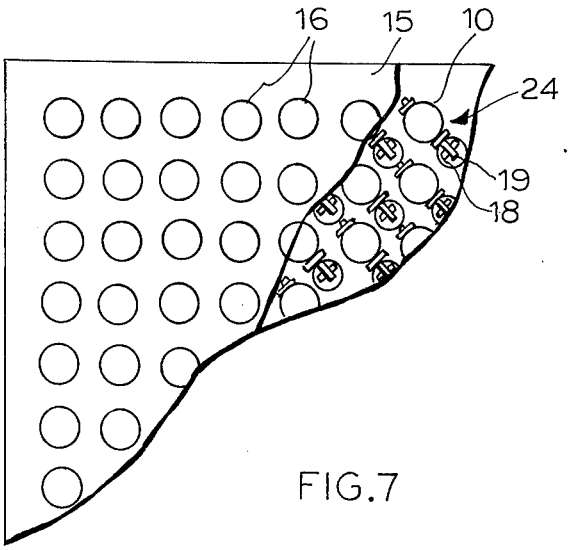
FIG. 7 is a partial plan view showing an arrangement of the elements shown in FIG. 3 in a display panel.

A plural number of such display units 24 are arranged in the configuration of a matrix, as shown in FIG. 7; the electromagnet 19 and the permanent magnet 18 of every display unit 24 are installed at a position where they are not visible through the holes 16 in the panel 15, that is, located in the space surrounded by four display elements 10, as shown in FIG. 7, and a plurality of light sources is provided. With this arrangement, there is no physical body which will obstruct the light coming from the light source inside or at the rear of the display element 10. For this reason, either in the daytime or at night, all the display elements have a uniformly shining appearance, thereby giving very clear indications.

Figure 8:
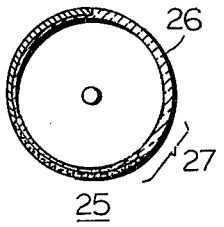
FIG. 8 is a transverse sectional view of a display element according to another embodiment of this invention.

While in the embodiment described in the foregoing, the display element 10 is a hollow ball, it is also possible to obtain a similar effect by making the whole of the display element a yellow transparent acrylic resin, without making it hollow. In such an embodiment, only the part of the display element in the 120° lune is coated with the black nontransparent color. This range is not limited to 120°, however, and any angle which is smaller than 180° but large enough to block the hole in the panel 15 will do in providing a similar effect. Furthermore, in the display element 25, as shown in FIG. 8, the inner transparent part 26 contained in the 120° lune on the inside of the transparent part 27 may be made with a transparent material, or may be notched, or some undulations may be provided on its surface to ensure better diffusion of light.

Figure 9:
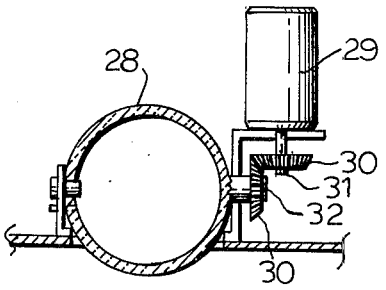
FIG. 9 is a transverse sectional view of still another embodiment of a display device according to this invention.

FIG. 9 shows another embodiment of the driving means for the display element 28, illustrating the use of a motor 29. Bevel gears 30 are respectively mounted on the shaft 31 of the motor 29 and the axle 32 of the display element 28.

In operating this device, the display element 28 is turned through the bevel gears 30, with the polarity of the current for energizing the motor 29 being changed.

Figure 10:
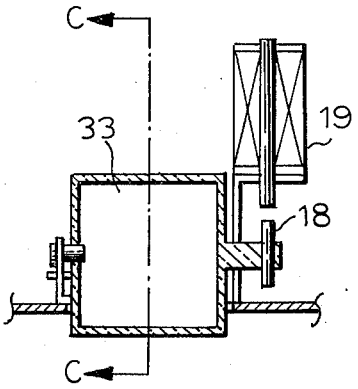
FIG. 10 is a sectional view of still another embodiment of a display device according to this invention.
Figure 11:
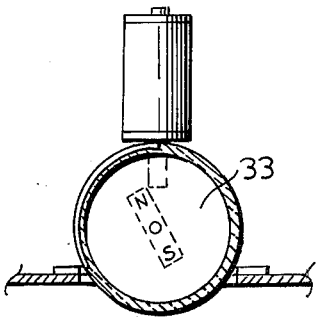
FIG. 11 is a sectional view taken along line C—C of FIG. 10.

FIGS. 10–11 show a display element 33 having a cylindrical shape, with only the part of the outer circumference contained in a center angle of 120° as the black nontransparent part.

Figure 12:
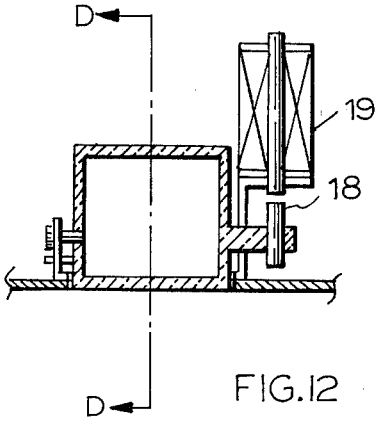
FIG. 12 is a sectional view of still another embodiment of a display device according to this invention.
Figure 13:
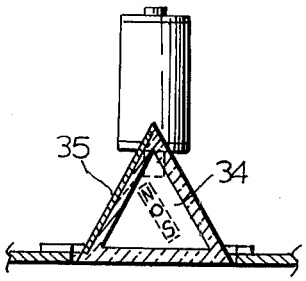
FIG. 13 is a sectional view taken on line D—D of FIG. 12.

The display element 34 of FIGS. 12–13 is a triangular prism, the triangular display element having one side as the black nontransparent part 35.

Figure 16:
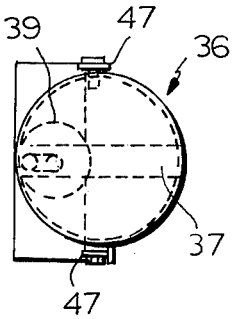
FIG. 16 is a sectional view taken on line E—E of FIG. 14.
Figure 14:
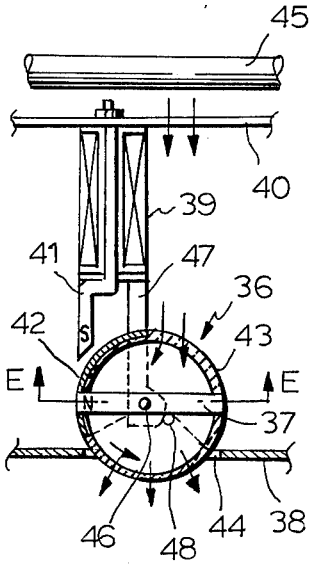
FIGS. 14 and 15 are sectional views of still another embodiment of a display device according to this invention.
Figure 15:
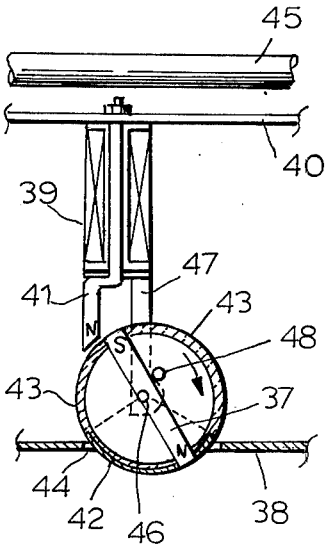

FIGS. 14–16 show another structure for installing the driving means and the display element of this invention.

Inside the display element 36, a permanent magnet 37 is diametrically disposed, extending at both ends to the outer circumference of the element 26 with its axis crossing the rotational axis 46 which is supported parallel to the panel 38 by a supporting plate 47. The magnet is brought parallel to the panel 38 when the transparent part 43 is in the hole 44 of the panel 38.

Figure 17A:
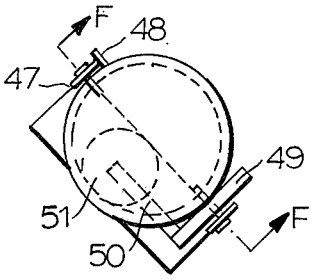
FIG. 17*a* is a plan view of still another embodiment of a display device according to this invention.
Figure 17B:
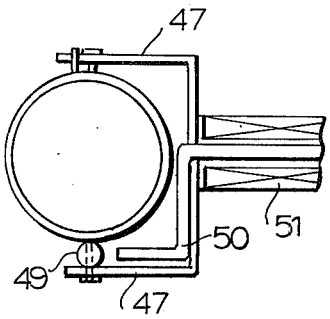
FIG. 17*b* is a sectional view taken on line F—F of FIG. 17*a;*

The electromagnet 39 is mounted on the light diffusing plate 40 with a tip part of the core 41 thereof turned toward the display element 36 and opposite the nontransparent part 42 which is located inwards of the panel 38 when the transparent part 43 of the display element 36 is in the hole 44 of the panel 38, that is, in the displaying position, as shown in FIG. 14. With this arrangement, even when the light source 45 is turned on at night, the electromagnet 39 does not cast its shadow on the transparent part 43. The permanent magnet 37 not only has a small diameter, but is held parallel to the panel 38 at a proper distance from the transparent part 43 in the hole 44. Accordingly, its shadow does not reach the hole 44. The transparent part 43 in the hole 44, then, shines very clearly with no irregularity of the light. The rotated position of the display element 36 is set by the cooperation of the supporting plate 47 and a pin 48 on the display element 36. According to this embodiment, the distance between neighboring display elements 36 can be small. If the diameter of the display element 36 is very small, however, there is a danger of the permanent magnet 37 installed inside the display element 36 casting its shadow on the transparent part 43 in the hole 49 at night. For this reason, it is preferable to mount the permanent magnet on the end of the rotational axle 46 outside of the display element 36, as shown in FIGS. 17*a* and 17*b*. Referring to FIGS. 17*a* and 17*b* numeral 49 represents the permanent magnet and 50 the core of an electromagnet 51.

Figure 18:
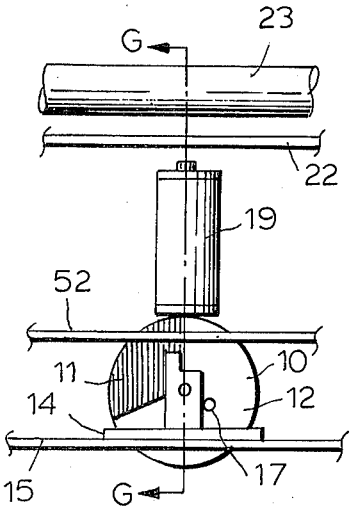
FIG. 18 is a elevational view of still another embodiment of a display device according to this invention.
Figure 19:
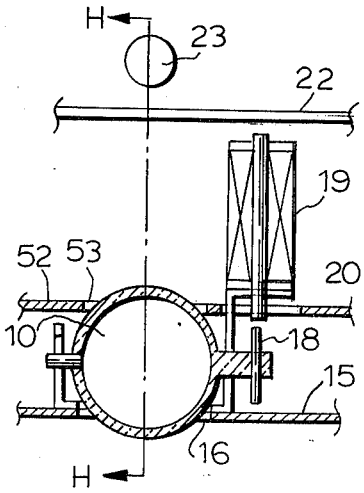
FIG. 19 is a sectional view taken on line G—G of FIG. 18.
Figure 20:
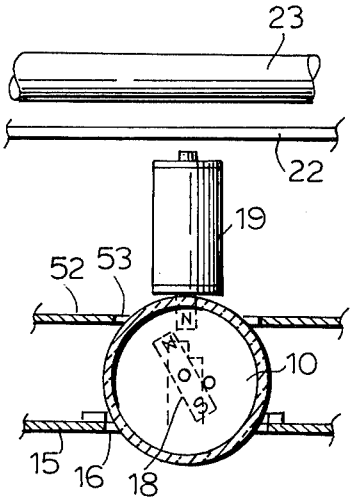
FIG. 20 is a sectional view taken on line H—H of FIG. 19.

FIGS. 18–20 illustrate a structure which is effective, for eliminating the leakage of light through the clearance between the hole 16 in the front panel 15 and the display element 10 when the light source 23 is turned on at night. This structure is the same as the embodiment of FIGS. 3–6 and to which is added to a rear panel 52. Aligned with the hole 16 in the front panel 15 is a hole 53 in the rear panel 52 provided at the rear of the display element 10 and having a size somewhat smaller than the display element 10. With this set-up, the light source 23 can not be directly seen through the hole 16 in the front panel 15. Thus, the leakage of light through the clearance between the hole 16 and the display element 10 is eliminated, thereby making the display very clear.

The operation of this embodiment is the same as that of FIGS. 3–6.

In mounting the permanent magnet on the rotary display element to serve as the driving means for this rotary display element, it is preferable to securely mount it inside the rotary display element for making the overall size of the device small. However, the permanent magnet must not block any of the light from the light source passing through the rotary display element. The following embodiment has a structure satisfying such requirements particularly for segments for numeral display.

Figure 23:
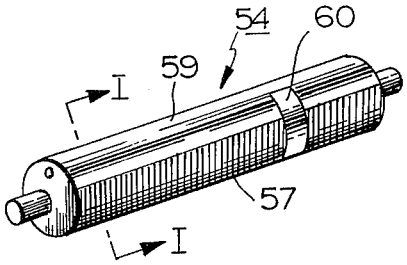
FIG. 23 is a perspective view of a display element in the display device of FIG. 21.
Figure 24:
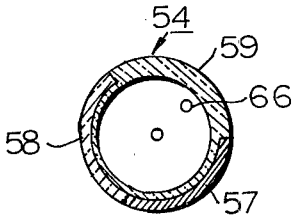
FIG. 24 is a sectional view taken on line I—I of FIG. 23.

Referring to FIG. 21–24, there is provided a cylindrical transparent rotary display element 54 having a diameter somewhat larger than the lateral width of the opening 55 in a panel 56, which cylinder is placed in the opening 55. The outer circumference thereof is divided into nearly equal three parts, a nontransparent display part 57, a transparent display part 58 and a transparent part 59, having the boundary running parallel to the rotational axis, as shown in FIGS. 23 and 24 (the transparent part 59 may be replaced by an enlarged transparent display part 58). The nontransparent display part 57 is black, the same color as that of the panel 56, for prevention of transmission of light, and the transparent display part 58 is coated with a highly transparent yellow acrylic resin, for example. A semi-circular permanent magnet 60 is embedded in the outer circumference of the rotary display element 53 on the opposite side from the transparent display part 58 and extends in the circumferential direction, straddling the nontransparent display part 57 and the transparent part 59. Bearings 61 support both ends of this rotary display element 54, and an electromagnet 62 aligned with magnet 60 rotationally drives the rotary display element 54 in cooperation with the aforementioned permanent magnet 60. The electromagnet 62 is composed of an iron core 63 and a coil 64, a shown in FIGS. 21 and 22, and is supported by the mounting plate 65 mounted on the panel 56 in the neighborhood of the rotary display element 54.

Figure 21:
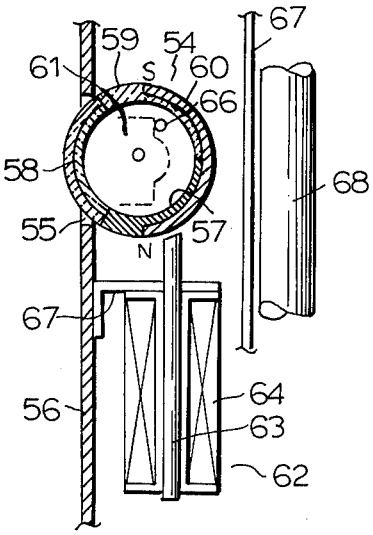
FIGS. 21 and 22 are sectional views of still another embodiment of a display device according to this invention.
Figure 22:
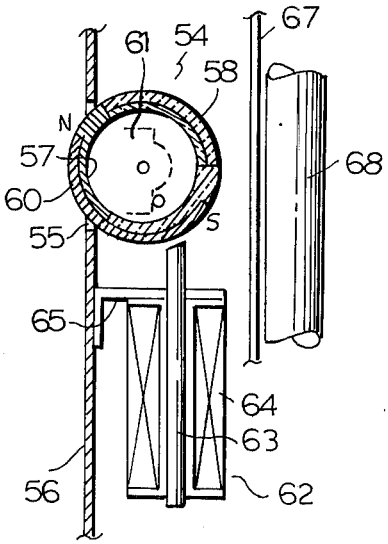

A stopper pin 66 is provided on one side of the rotary display element 54, which is adapted to limit the turning of the rotary display element 54 by abutting the end of the bearing 61. Behind the rotary display element 54 are a light diffusing plate 67 and a light source 68 with which the rotary display element 54 is irradiated, to project the light to the outside of the opening 55 through the transparent display part 58 when it is in the opening 55 side of the panel 56, as shown in FIG. 21, thereby providing the indication. It is appropriate to coat the inside surface of the aforementioned nontransparent display part 57 to ensure good reflection of light.

Figure 25:
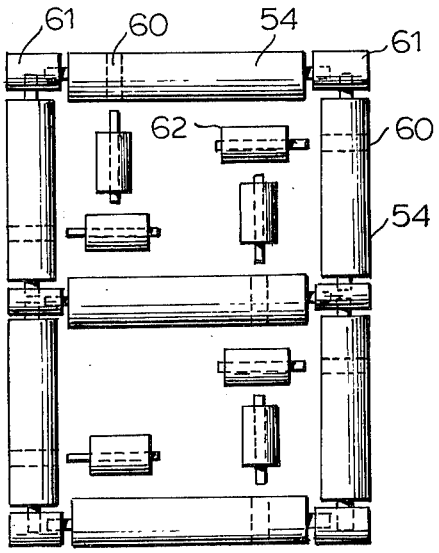
FIG. 25 is a plan view showing an arrangement of the display devices shown in FIG. 21.

The operation of this display device is the same as the device of FIGS. 5–6. A plurality of display units can be arranged as numeral segments in the manner as shown in FIG. 25.

In the embodiment above described, one-third of the outer circumference of the rotary element 54 is the transparent part 59, but this transparent part 59 may be eliminated by forming the two-third of the outer circumference as a transparent display part 58. Furthermore, it is not objectionable for the light from the light source 68 to be irradiated on the transparent display part 58 placed in the hole 55 to enlarge the nontransparent display part 57 to larger than one-third but smaller than one-half of the outer circumference of the rotary display element 54 in order to provide proper shielding of the hole 55 in the panel 56. The structure of the embodiment above described, may be applied to devices in which spherical rotation elements are used.

What is claimed is:

1. In a display device of the type having a display element with a surface including different colored areas, which display element is rotatably mounted opposite an opening of a front panel, and including means for controlling the rotational position of said display element to selectively expose a specified colored area through the opening of the front panel, the movement comprising:

the surface portion of said display element having a non-transparent area, a transparent area having a color different from the color of said non-transparent area, and a light passing portion which is positioned inside the front panel when said transparent area is exposed through the opening of the front panel, said light passing portion being optically connected to said transparent area and said non-transparent area having a size for completely covering said opening in the front panel when said non-transparent area is exposed to said opening; and a light source positioned behind said display element, whereby the light from the light source is scattered to the otuside of the front panel through the display element when the transparent area is exposed through the opening.

2. The improvement as claimed in claim 1 in which said transparent area extends around said element to form said light passing portion.

3. The improvement as claimed in claim 1 in which said display element is a hollow body having an opening in the wall thereof constituting said light passing portion.

4. The improvement as claimed in claim 1 in which said means for controlling the rotational position of said display element comprises a permanent magnet securely attached to the display element and an electromagent mounted adjacent said display element.

5. The improvement as claimed in claim 1 further comprising a light diffusing plate between said light source and said display element.

* * * * *